US010676980B2

(12) United States Patent
Grant et al.

(10) Patent No.: US 10,676,980 B2
(45) Date of Patent: Jun. 9, 2020

(54) CASH SPOILING SYSTEM

(71) Applicant: ATM SECURITY SYSTEMS INTERNATIONAL LIMITED, London (GB)

(72) Inventors: Duncan John Grant, West Sussex (GB); Peter Mila, West Sussex (GB); Peter Rogers, West Sussex (GB)

(73) Assignee: ATM SECURITY SERVICES INTERNATIONAL LIMITED, London (GB)

( * ) Notice: Subject to any disclaimer, the term of this patent is extended or adjusted under 35 U.S.C. 154(b) by 47 days.

(21) Appl. No.: 15/125,586

(22) PCT Filed: Mar. 11, 2015

(86) PCT No.: PCT/GB2015/000086

§ 371 (c)(1),
(2) Date: Sep. 13, 2016

(87) PCT Pub. No.: WO2015/136235

PCT Pub. Date: Sep. 17, 2015

(65) Prior Publication Data

US 2016/0376828 A1 Dec. 29, 2016

(30) Foreign Application Priority Data

Mar. 13, 2014 (GB) ..... 1404502.5

(51) Int. Cl.
*E05G 1/14* (2006.01)
*G07D 11/12* (2019.01)

(52) U.S. Cl.
CPC ..... *E05G 1/14* (2013.01); *G07D 11/12* (2019.01)

(58) Field of Classification Search
CPC . E05G 1/12; E05G 1/14; G07D 11/12; G07D 11/125
USPC ..... 109/20, 25, 29–34
See application file for complete search history.

(56) References Cited

U.S. PATENT DOCUMENTS 2,384,826 A * 9/1945 Ferguson ..... E05G 1/14 109/25
3,096,940 A * 7/1963 Burleigh ..... E05G 1/10 239/272
3,349,729 A * 10/1967 Georges ..... E05G 1/14 109/25

(Continued)

FOREIGN PATENT DOCUMENTS

BR MU9101813 U2 7/2012
EP 0692599 1/1996

(Continued)

*Primary Examiner* — Lloyd A Gall
(74) *Attorney, Agent, or Firm* — Smith IP Services, P.C.

(57) ABSTRACT

A system for spoiling banknotes arranged in a block formation within a container. The apparatus of the system comprises spoiling fluid contained within a receptacle located within the container. Also provided are structure configured to release the fluid from the receptacle and structure configured to direct the released fluid over and along one entire side of the block of banknotes. A manifold having at least one channel or groove provides directional structure along which the spoiling fluid travels. The spoiling fluid is dispersed from the manifold along an edge thereof onto the banknotes.

13 Claims, 5 Drawing Sheets

(56) References Cited

U.S. PATENT DOCUMENTS

| | | | | |
|---|---|---|---|---|
| 4,799,435 | A * | 1/1989 | Boutroy | G07D 11/12 109/25 |
| 5,732,638 | A | 3/1998 | Van Lint | |
| 6,259,366 | B1 * | 7/2001 | Lindskog | E05G 1/14 109/25 |
| 8,464,648 | B2 * | 6/2013 | Villiger | E05G 1/14 109/25 |
| 8,631,748 | B2 * | 1/2014 | Tavares de Pinho | E05G 1/14 109/20 |
| 8,783,194 | B2 * | 7/2014 | Sleat | D21H 21/46 109/20 |
| 2003/0005882 | A1 * | 1/2003 | Fumanelli | E05G 1/005 118/300 |
| 2003/0011466 | A1 * | 1/2003 | Samuel | A45C 13/24 340/5.73 |
| 2003/0033965 | A1 * | 2/2003 | Van Lint | E05G 1/14 109/29 |
| 2003/0122673 | A1 | 7/2003 | Anderson | |
| 2004/0144569 | A1 * | 7/2004 | Pritchard | E05G 1/14 175/99 |
| 2004/0154500 | A1 * | 8/2004 | Richard | E05G 1/005 109/25 |
| 2005/0000396 | A1 * | 1/2005 | Dyson | E05G 1/14 109/25 |
| 2007/0251431 | A1 * | 11/2007 | Villiger | A45C 13/18 109/29 |
| 2009/0235847 | A1 * | 9/2009 | Villiger | E05G 1/14 109/25 |
| 2012/0240829 | A1 * | 9/2012 | Van Dessel | E05G 1/14 109/25 |
| 2013/0055932 | A1 * | 3/2013 | Berendes | E05G 1/14 109/25 |
| 2015/0027354 | A1 * | 1/2015 | Berendes | E05G 1/005 109/25 |
| 2015/0191960 | A1 * | 7/2015 | Robson | B65D 85/00 109/25 |

FOREIGN PATENT DOCUMENTS

| | | |
|---|---|---|
| EP | 1209312 | 5/2002 |
| FR | 2846699 | 5/2004 |
| FR | 2975424 | 11/2012 |
| GB | 1446711 | 8/1976 |
| GB | 2340879 | 3/2000 |
| GB | 2474581 | 4/2011 |
| GB | 2478549 | 9/2011 |
| GB | 2484484 A | 4/2012 |
| WO | 83/02975 | 9/1983 |
| WO | 95/28542 | 10/1995 |
| WO | 98/03758 | 1/1998 |
| WO | 03/065316 | 8/2003 |
| WO | 2005/010306 | 2/2005 |

* cited by examiner

CASH SPOILING SYSTEM

RELATED APPLICATIONS

The present application claims priority as a US national phase under 35 U.S.C. 363 of PCT/GB2015/000086 filed on Mar. 11, 2015 which claims priority from patent application No. 1404502.5 filed in Europe on Mar. 13, 2014, the disclosures of which are incorporated herein by reference.

FIELD OF THE INVENTION

The present invention relates to a cash spoiling system inter alia for use in automatic teller machines (ATMs) which spoils banknotes in the event of an attempted theft. More especially, the present invention relates to a spoiling system which spoils notes, rendering them unusable, but which also allows for individual notes to be subsequently authenticated.

BACKGROUND TO THE INVENTION

Brute force attacks on ATM machines are a common form of robbery by thieves intending to steal the cash contained within an ATM. Often, and in the case of stand-alone ATM machines of the type found in convenience stores for example, the ATM machines are generally not secured in place and may simply be picked up by thieves and taken away. Following this, and without time constraints, the thieves use various tools to cut open the machine to obtain the cash.

In the case of ATM machines which are typically located within the structural walls of banks or supermarkets, for example, it is becoming increasingly common for thieves to use heavy duty construction vehicles to rip the ATM from the wall of the building. In some cases, it has been known to use explosives to achieve the same result. Aside from the financial implications resulting from the loss of the cash contained within the ATM, the costs for repairing the structural damage caused to the building, which by this time is unsafe for public access, are highly significant.

Typically, refillable cassettes are used to store banknotes in ATMs. The cassettes, which contain various denominations of banknotes are installed in carriage located within the ATM in a manner which allows individual banknotes to be accessed by a user of the ATM. Standard practice for replenishing the ATM with banknotes generally involves removing the empty cassettes and replacing them with a new set of pre-filled cassettes.

Various methods of deterring theft already exist and include cash spoiling systems which activate in response to an appropriate signal indicative of an attempted theft. Known spoiling systems include the release of an indelible dye or ink onto the banknotes within the cassette when a signal is received from a sensor indicating that the ATM is being tampered with. Such inks or dyes stain the banknotes with the intention of rendering them unusable and hence worthless.

Given the increased automated nature of today's service providers however, many types of machines exist which accept notes for payment. The acceptance of notes is based purely on the structural integrity of the notes received by the machine and only notes whose physical integrity has been compromised will be rejected. Consequently, stained notes are generally accepted in such machines and are only discovered after the machine is emptied or when the spoiled notes are presented to the bank.

In the case of the gaming industry, for example, bets can be made through depositing notes in automated machines. It is however, possible to cancel a transaction prior to a bet taking place, at which point a token or ticket is printed detailing the amount owed. The ticket is then exchanged over the counter for cash. This essentially provides a thief with an undiscoverable method of exchanging the stained notes for legal tender.

Another known method of spoiling banknotes involves the use of an adhesive as the spoiling agent. The adhesive is deposited over the banknotes which acts to bond them together, and in some cases then curing, to form what is essentially a solid block of banknotes. In such systems however, the adhesive is simply sprayed into the cassette over the notes in a non-uniform chaotic manner in an attempt to ensure that all of the notes are bonded together to render them useless.

The problem associated with known adhesive systems is that individual notes cannot be subsequently partly separated to be properly authenticated.

Since the adhesive is deposited over the banknotes in an unpredictable and disorderly manner, it is not possible to guarantee that all of the notes are rendered unusable as it is possible that some of the notes may still be individually peeled away from one another. Alternatively and additionally, if notes are bonded together to form a solid block, they are no longer individually identifiable to the responsible authority (e.g. The Bank of England in the United Kingdom).

The ability to be able to identify the banknotes as authentic is essential if the responsible authority is to replace each spoiled note with new legal tender. Not being able to do so means that those notes are not replaced and any resulting financial loss must be incurred by the aggrieved party.

GB2476061B describes a cassette for storing banknotes which includes a spoiling system. This cassette has a means for detecting interference, which if detected, activates the spoiling system dispensing a degrading agent onto the interior of the inner cassette.

GB2340879B describes a cassette for storing banknotes which includes a cash spoiling system. In this system, a spoiling/bonding solution is sprayed over the banknotes following activation of the system. The solution is contained within a receptacle and expels the adhesive in response to a warning signal received from a beacon. The solution is sprayed from a delivery tube attached to a holding plate of the cassette. There is no disclosure of the mechanism by which the solution is dispersed.

Tests have shown that adhesive sprayed from THE side of the holding plate is not effective over the entire length of the block of notes as the holding plate, by its very purpose, rests against the top of the block of notes and, as such, any gap between the plate and the notes is minimal. Consequently, the solution will be expelled primarily at points where gaps are present or are the most prevalent as so the solution would only effectively be dispersed over those areas where the notes are smaller (five pound notes rather than twenty pound notes) where no notes are present if the cassette is not completely filled. The remainder of the notes will remain unspoilt.

Moreover, the system disclosed in GB2340879 (all be it in very limited detail) would require the interior of the cassette to be disassembled and adapted to connect and fit the delivery tube to the holding plate. This makes retrofitting of the apparatus difficult.

In the prior art described, the unpredictable depositing of the degrading agent renders it not possible for the spoiling system to work in such a way as to ensure that each banknote is completely unusable and still identifiable as authentic.

This and other disadvantages are overcome, or at least alleviated, with the spoiling system in accordance with the present invention.

SUMMARY OF THE INVENTION

According to a first aspect of the present invention there is provided apparatus for spoiling banknotes arranged in a block formation within a container, the apparatus comprising a main housing in which is located a receptacle containing a spoiling fluid, the housing having a channel formed along one side, the apparatus further comprising means to release the fluid from the receptacle and into the channel so to direct the fluid over and along one entire side of the block of banknotes within the container.

Preferably, the spoiling fluid is an adhesive.

Preferably, the container comprises a box-like structure with a hinged lid and wherein the apparatus of the system are secured within underside of the lid.

Preferably, the means to release the fluid from the receptacle is responsive to a signal indicative of an attempted theft.

Preferably the apparatus further comprises a first end housing attached in use to the end of the main housing, and means to attach an actuator to the first end housing.

Preferably the end housing is constructed in first and second parts, the first part being rotatable relative to the second part, and wherein the actuator is located in the first part such that rotation of that part exposes the actuator for replacement.

Preferably the first end housing also includes a piston assembly and means, activated by the actuator, to drive the piston into the main housing.

Preferably the apparatus comprising a second end housing attached in use to the other end of the main housing to that receiving the first end housing, the second end housing including a spike extending inwards into the main housing to pierce the receptacle on abutment thereby releasing the spoiling fluid.

Preferably, the spike has an internal throughbore to provide an outlet through which the fluid can flow from the receptacle into an internal channel formed in the second end housing.

Preferably the second end housing has an exit aperture to allow the fluid to exit the second housing into the channel.

According to a second aspect of the present invention, there is provided an automatic teller machine comprising a sensor to provide a signal indicative of an attempted theft of the machine and at least one carriage to receive one or more containers according to the first embodiment, and wherein the fluid from the receptacle is released in response to a signal received from the sensor.

Preferably, the sensor is a motion or tilt sensor.

According to a third aspect of the present invention, there is provided a method for spoiling banknotes arranged in a block comprising releasing spoiling fluid from a receptacle located within a housing, the housing have an external channel formed along one side of its length, such that the released fluid flows from the receptacle into the channel of the housing thereafter being directing over the banknotes.

There is also provided a system for spoiling banknotes arranged in a block formation within a container, the apparatus comprising a spoiling fluid contained within a receptacle located within the container, means to release the fluid from the receptacle, and means to direct said released fluid over and along one entire side of the block of banknotes, wherein the directional means comprises a manifold having at least one channel or groove along which the adhesive travels and wherein the fluid is dispersed from the manifold along an edge thereof onto the banknotes.

Preferably, the lid comprises a holding plate extending along one side of the lid and wherein the manifold is secured to the holding plate.

Preferably, the longitudinal edge of the manifold abuts out from the longitudinal edge of the holding plate.

Preferably, the fluid is dispersed along the abutting edge of the manifold.

BRIEF DESCRIPTION OF THE DRAWINGS

The invention will now be described by way of example only with reference to the accompanying diagrammatic drawings in which.

DETAILED DESCRIPTION OF THE INVENTION

Figure 1:
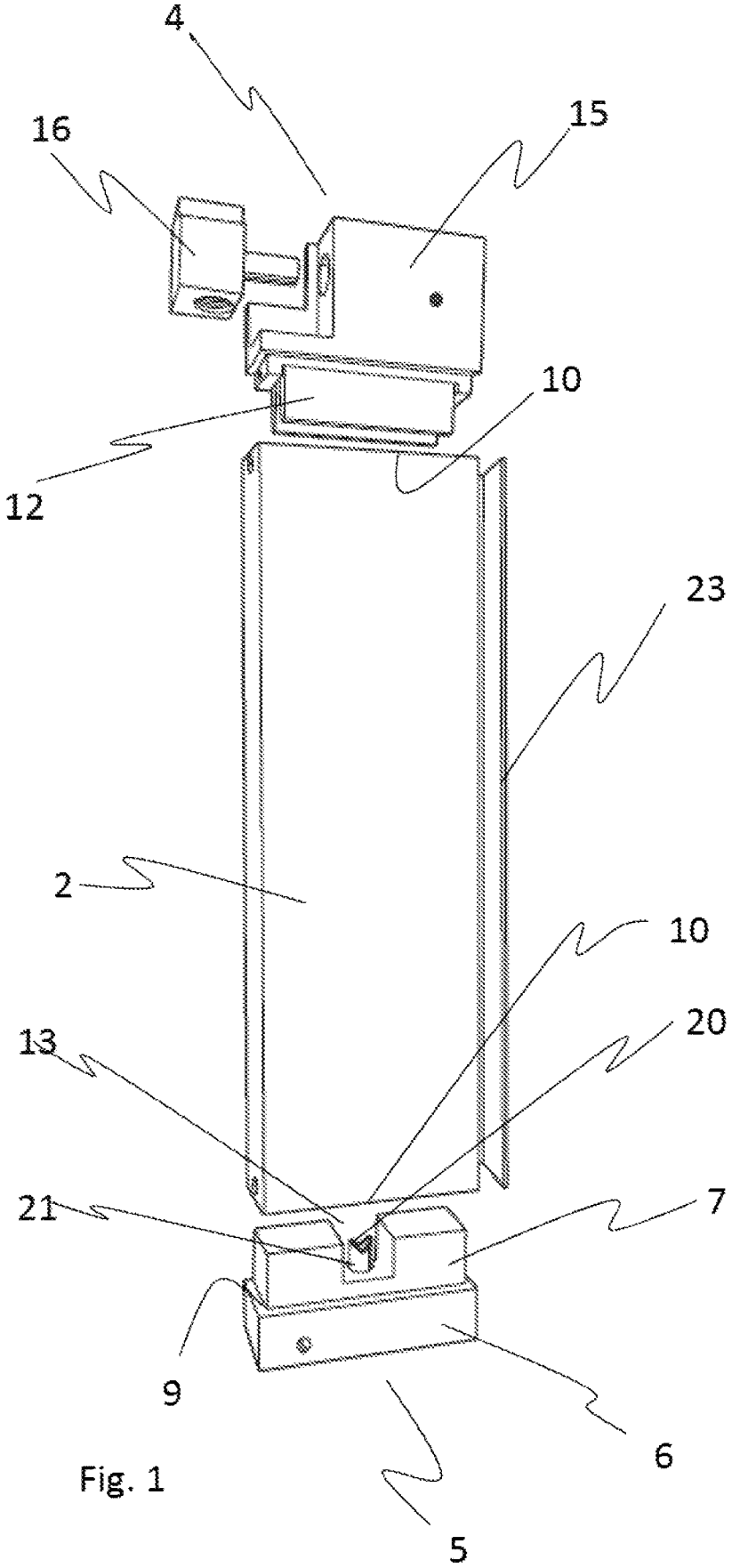
FIG. 1 is an exploded view of a cash spoiling apparatus constructed in accordance with the invention.

FIG. 1 shows cash spoiling apparatus forming part of an overall system to render cash useless in the event of an attempted theft.

Figure 6:
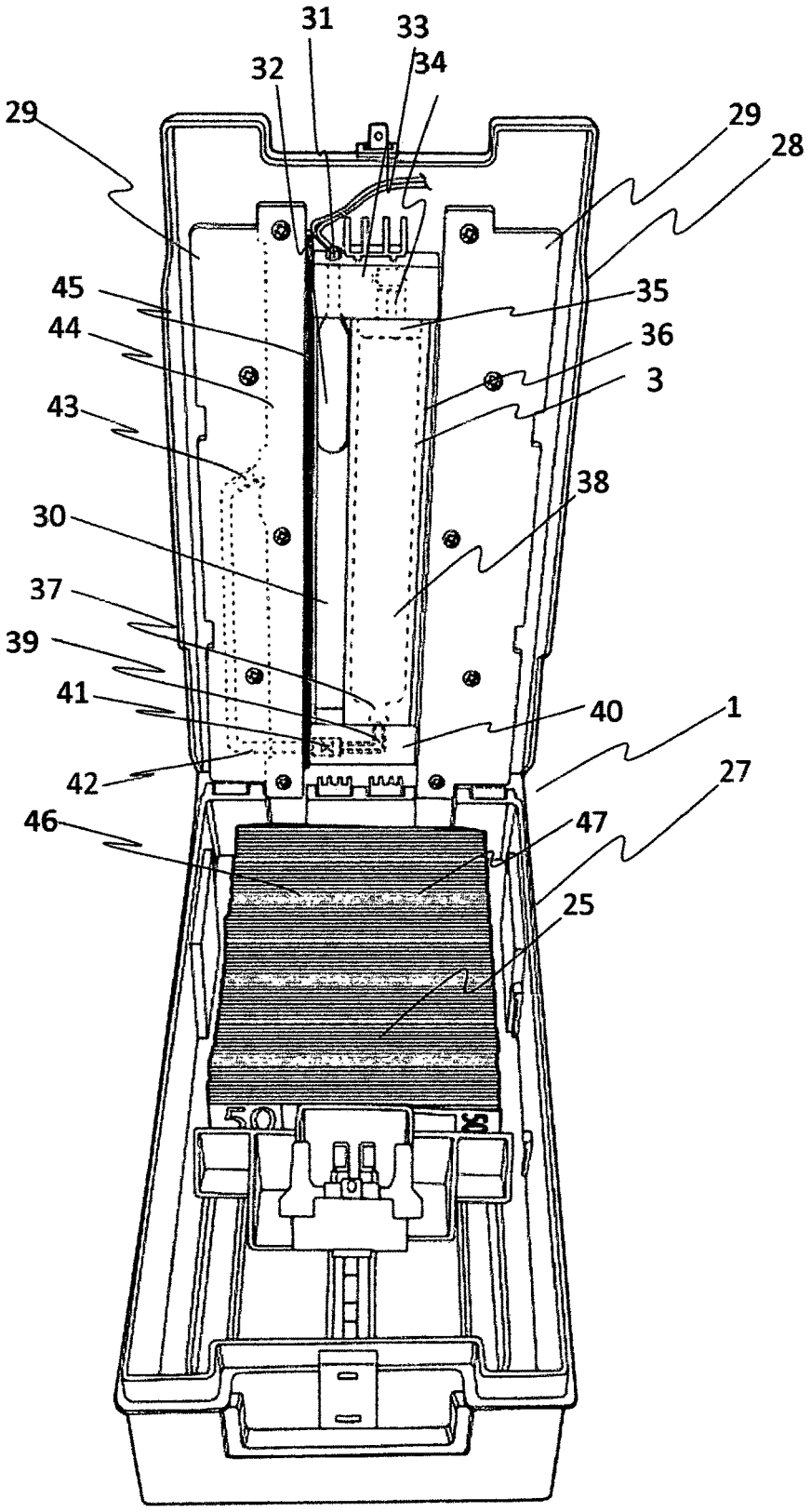
FIG. 6 is a perspective view of a cassette containing a cash spoiling system.
Figure 7:
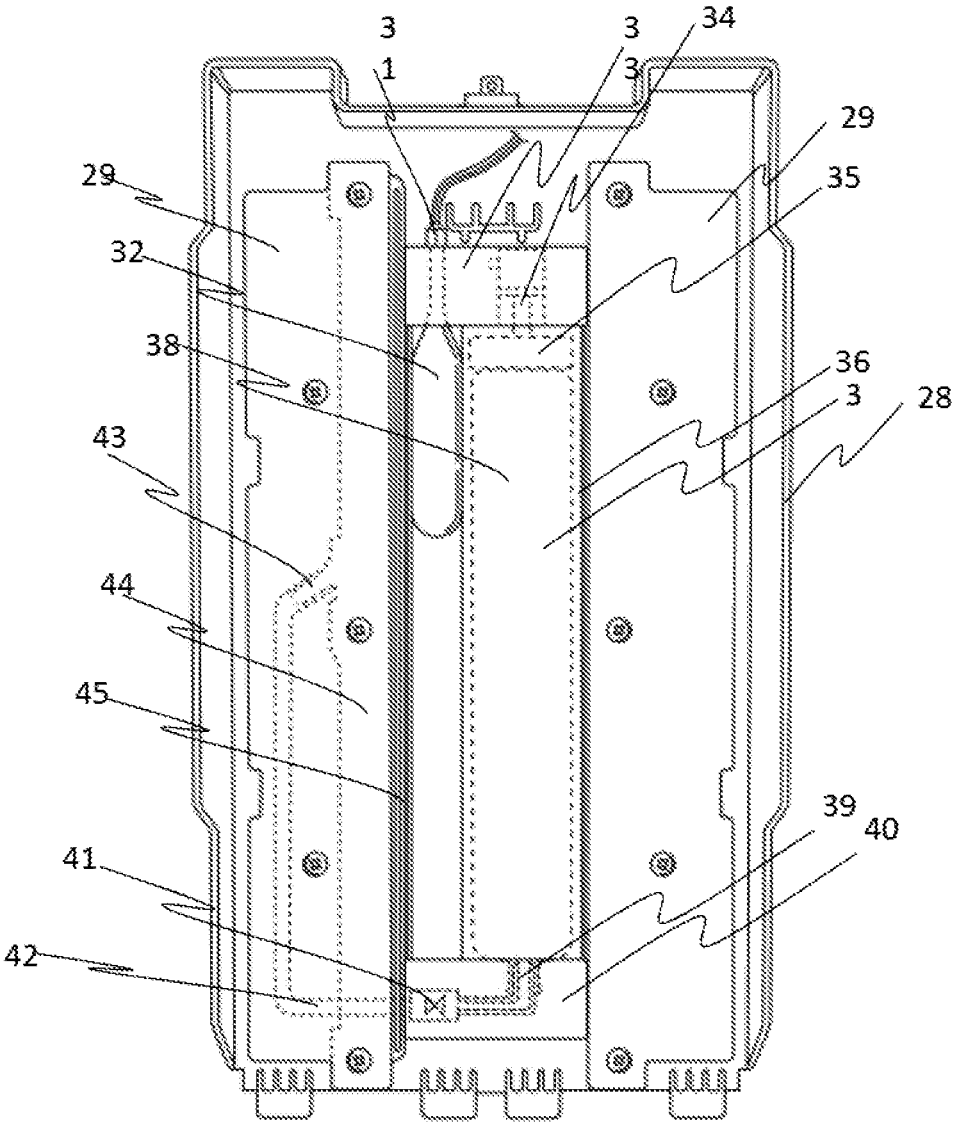
FIG. 7 is a plan view of the portion of the cassette containing the spoiling system of FIG. 6.

As illustrated in FIGS. 6 and 7 the apparatus is designed to be located within a cassette 1 for an ATM.

The apparatus includes a main housing 2 comprising a hollow rectangular section made from metal, for example aluminium. A receptacle containing a spoiling agent, for example a liquid adhesive, is located within the housing. The receptacle is not shown in FIG. 1 but a suitable receptacle 3 is shown in dotted lines in FIGS. 6 and 7.

The receptacle may, for example, take the form of an elongate generally rectangular container 3 as shown in those figures, or it may take a less-structured form such as a foil poach.

The receptacle is compressible laterally but not longitudinally to any substantial extent. If the receptacle is in the form of a pouch, it may require reinforcement along its longitudinal axis to prevent it from compressing longitudinally. The reinforcement may be provided for example, by security or tamper-evident stickers.

The receptacle 3 contains adhesive in use and has a neck at the end of which is an outlet closed by a foil lid.

An end housing 4, 5 is provided at each end of the main housing 2. The end housings 4, 5 have profiles matching the main housing 2 to allow them to fit over and within the ends of the main housing 2.

Figure 2:
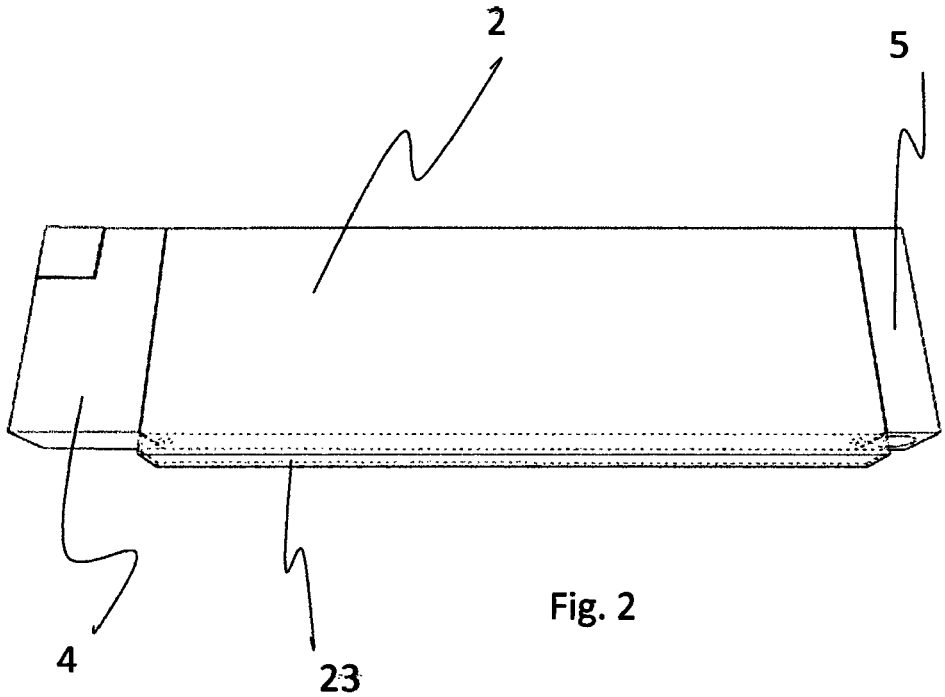
FIG. 2 shows the cash spoiling apparatus of FIG. 1 in constructed form.

Each end housing 4, 5 has a base section 6 and a step 7 of lesser dimension than the base 6 extending from the base 6 providing the base section 6 with an abutment surface 9. The apparatus is constructed by fitting the end housings 4, 5 over the ends of the main housing 2 such that the steps 7 slide snugly into the main section 2 and the abutment surface 9 of each end housing 4, 5 abuts the end rim 10 of the main housing 2. The outer surfaces of the main housing 2 and end housings 4, 5 sit flush with each other once connected, as can be seen in FIG. 2.

One end housing 4 holds an actuator 11 and piston 12 for the cash spoiling system and is hereinafter referred to as the "actuator housing 4".

Figure 5:
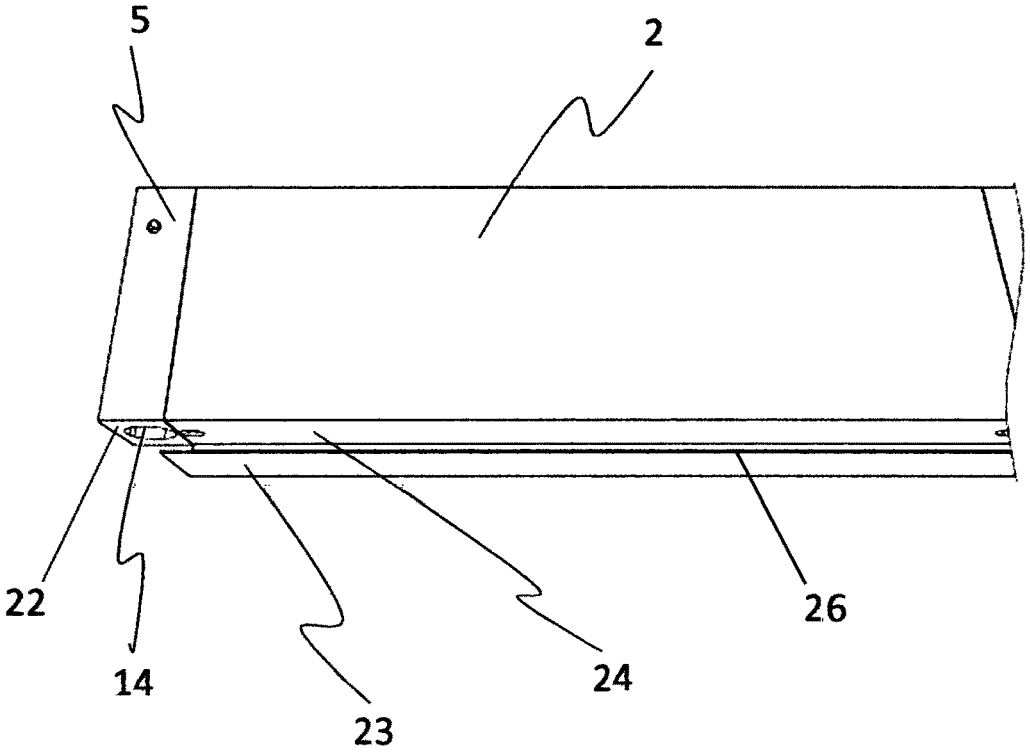
FIG. 5 is a perspective of primarily one end of the spoiling apparatus.

The other end housing 5 holds a receptacle penetrator in the form of a tubular spike 13, and has an exit outlet 14 for the adhesive (shown in FIG. 5). This end housing 5 is hereinafter referred to as the "exit housing 5".

Figure 3:
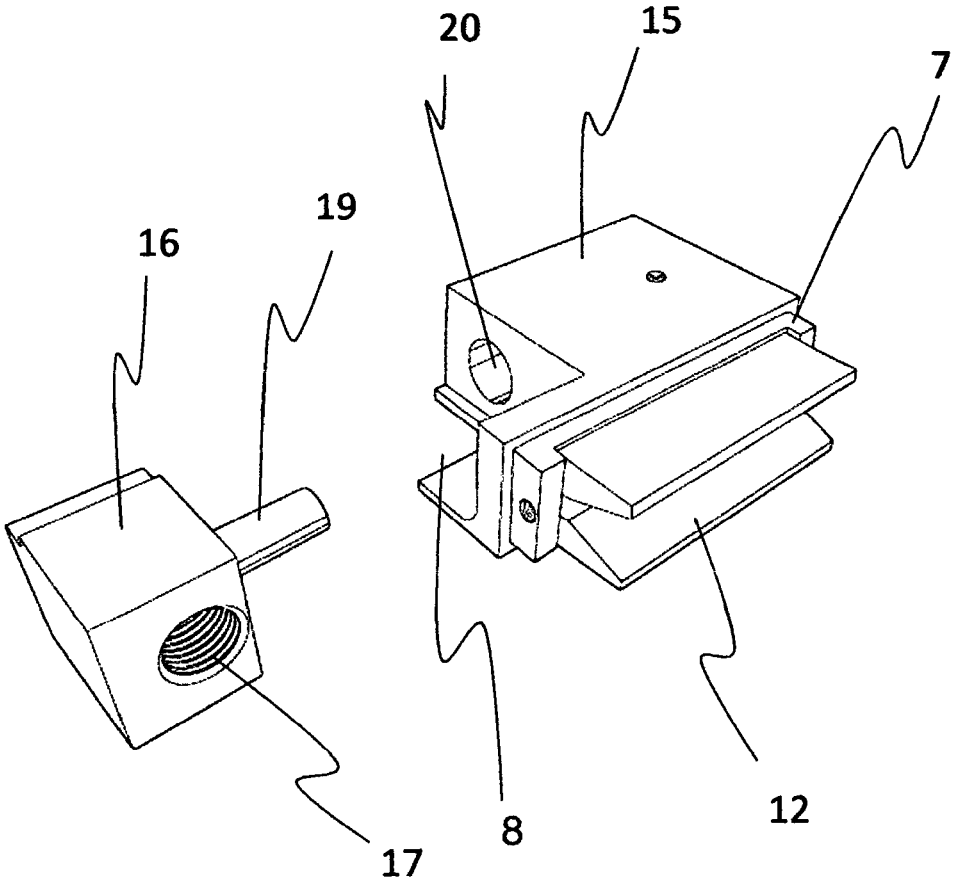
FIG. 3 is perspective view of the actuator and piston housing of the apparatus.

The actuator housing 4 can be seen in FIG. 3. The base 6 of the housing 4 comprises a first main section 15 and a second smaller section 16 pivotally attached to the first section 15 and fitting within a recess 8 formed in one side of the main section 15.

Figure 4:
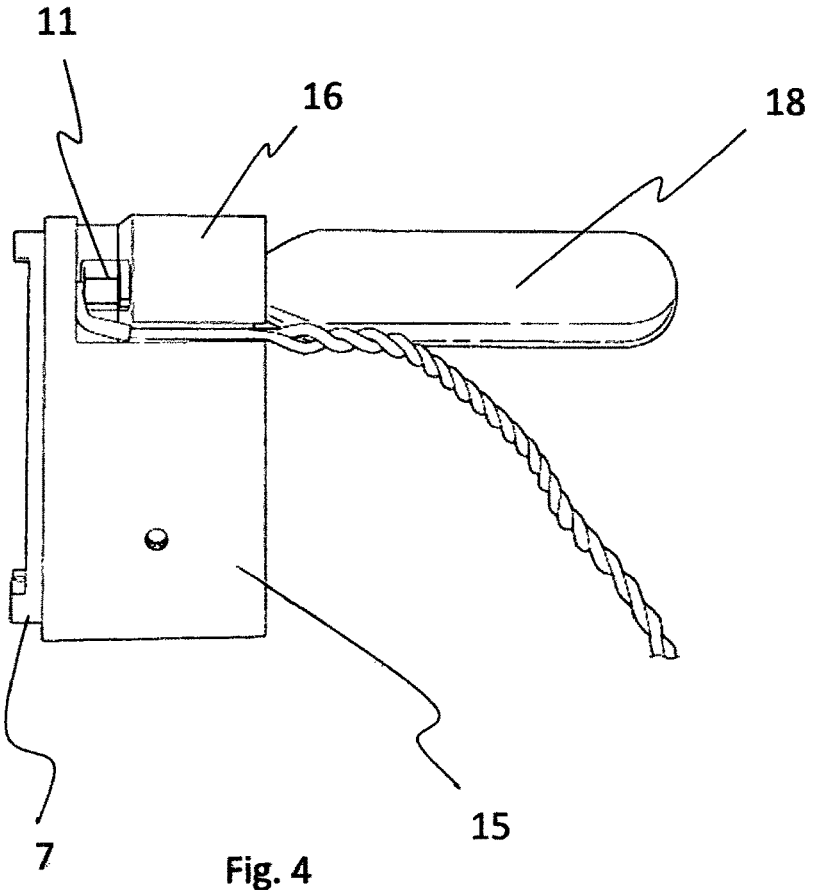
FIG. 4 is a perspective view showing the actuator mechanism of the apparatus.

As can be seen in FIG. 4, the actuator 11 is attached to the second section 16 via a threaded bore 17. The actuator 11 is wired to a PCB board (not shown) and activates the cash spoiling system in response to a signal being received by the PCB.

As can be seen best in FIG. 4, a gas cylinder 18 is connected to the other side of the threaded bore 17 and is activated by the actuator 11 on receipt of the appropriate signal.

The second section 16 includes a hollow rod section 19 extending outwardly from one side. The rod 19 is received within an aperture 20 formed in a side of the first section 15.

The rod 19 is rotatable within the aperture thereby allowing the second section 16 to rotate relative to the first section 15. This allows the actuator 11 to be easily replaced without the need to disassemble the apparatus. The second housing 16 can be simply rotated to expose the actuator 11 for replacement without the need to disconnect the actuator housing 4 from the main housing 2.

The first section 15 of the actuator housing 4 includes a piston 12 extending downwardly from the step 7. The piston 12 is V-shaped and made from a rigid plastic.

The aperture 20 formed in the main section 15 extends to an internal channel (not shown) within section 15 and ends in an aperture (also not shown) directly behind the piston 12.

The piston 12 has a cylindrical section (not shown) that fits within the exit aperture of the internal channel The gas cylinder 18, when activated by the actuator 11, expels gas initially into the second section 16 of the actuator housing 4. The gas then travels through the connecting rod 19 and into the main section 15. Finally the gas travels through the internal channel of the main section 15 and out the exit aperture forcing the cylindrical section of the piston 12 back through the exit aperture thereby pushing the piston 12 away from the step 7 of the actuator housing 4 and into the main housing 2 of the apparatus.

When pushed into the housing, the piston 12 abuts the end of the receptacle 3, the jaws of the Y-shape face of the piston 12 clamp around the end of the receptacle 3 and push the receptacle 3 to the far end of the housing 2 towards the exit housing 5.

The tubular spike 13 of the exit housing 5 extends inwardly into the main housing 2. The tubular spike 13 acts to puncture the foil lid of the receptacle 3 as the receptacle 3 is pushed against the exit housing 5, thereby opening the receptacle 3 to expel the adhesive from within.

The step 7 of the exit housing 5 has a central recess in which the spike 13 is located. The walls of the step 7 either side of the spike 13 abut the receptacle 3 to prevent it from continuing to be forced against the exit housing 5 after the foil lid has been pierced. The depth of the step 7 is less than the neck of the receptacle 3 to ensure that the spike 13 is able to pierce the lid.

The pressure differential produced within the main housing 2 surrounding the receptacle and the fact that the receptacle 3 is stopped by the steps 7 of the exit housing 5, causes the receptacle 3 to laterally compress to continue to force the adhesive from the receptacle 3.

The spike 13 is formed by providing the end of the tube with a sharp edge 20. The main body 21 of the spike 13 has a through bore providing a channel through which the adhesive flows once it leaves the receptacle 3.

The base of the spike 13 extends to an internal channel (not shown) within the exit housing 5 which in turn extends to the exit aperture 14 formed in one side 22 of the exit housing 5.

A spray bar 23 extends along the length of the main housing 2.

The spray bar 23 may be made from plastic or similar material and is secured to the main housing 2 or may be formed integral with the main housing 2. The spray bar 23 is generally L-shaped and extends upwardly and along the side of the housing 2.

The exit aperture 14 leads into a tube (not shown) which directs adhesive into the channel 24 formed by the spray bar 23.

Adhesive flowing from the receptacle 3 out the exit aperture 14 is directed along the channel 24 at which point the flow is directed downwardly onto the banknotes 25 (see FIGS. 6 and 7) to cover the entire length of the block of banknotes 25.

The fact that the adhesive is only sprayed along one side of the housing 2 means that only a proportion of the width of the block of notes 25 is adhered together. This means that each note can be individually inspected and authenticated in the region not affected by the adhesive.

In this embodiment, the spray bar 23 is secured to the housing 2 rather than the cassette holding plate 29 to ensure that an appropriate gap is provided between the bank notes 25 and the top edge 26 of the spray bar 23 irrespective of the (varying) size of the notes 25 within the cassette 1 and/or how full the cassette 1 is.

Further, location of the spray bar 23 on the housing 2 prevents the need for the holding plate within the cassette to be disassembled in order to fit a spray bar. Consequently, the apparatus hereinbefore described is more applicable to retrofitting into standard cassettes.

FIGS. 6 and 7 illustrate the cash spoiling apparatus within a cassette 2 for an ATM. The cassette 2 is one which is commonly used in the market today and comprises a box-like structure with a base 27 and a hinged lid 28. In use, the banknotes 25 are placed in the cassette 2 and are arranged in a uniform rectangular block across the width of the cassette and extend length-ways, with the face of each individual note neatly arranged against its neighbour, as illustrated.

Once the notes are in place, the hinged lid 28 is then closed over and secured to the base 27 using a standard securing mechanism (not shown).

The cash spoiling apparatus is located within the lid 28 of the cassette 2. In the same way as standard ATM cassettes, two adjacent holding plates 29 are located within the lid 28, which when the lid 28 is closed, rest on the banknotes 25 and assist in holding the notes 25 in place. A recess 30 is located between the holding plates 29. This recess 30 provides a convenient location for the cash spoiling apparatus.

The cash spoiling apparatus shown in FIGS. 6 and 7 has slight differences in design to that of FIGS. 1 to 5. The majority of differences are apparent from the figures and only the main differences are detailed further below. It is however clear that the apparatus described above has equivalent features where necessary to make it equally applicable for installation and use in a cassette 1 in the same way as will be described below.

The working part of the cash spoiling apparatus comprises a detonator 31 connected to a gas canister 32, via a gas block 33. The detonator 31 is connected via a wire to a sensing device, for example a vibration, light or other sensor (not shown), located on the cassette but within the ATM, and which when activated, triggers the detonator 31. It is envisaged that the detonator 31 may alternatively be wirelessly and/or remotely linked to some other form of triggering device, which may be in the ATM or be remote from it.

Within the gas block 33 is located a piston arrangement 34 which, includes a nylon block 35, located between the gas block 33 and a housing 36 containing the receptacle 3.

In use, upon activation of the detonator 31, the gas canister 32 releases gas (e.g. $CO_2$) into the gas block 33 forcing the piston 34 down, which in turn pushes the nylon block 35 against the receptacle 3, pushing the receptacle 3 along the housing 36. The covered opening of the receptacle 3 is pushed against a hollow spike 37 to pierce the cover, thereby allowing adhesive 38 to be released from the receptacle 3. As the housing 36 continues to be filled with the gas from the gas canister 32, a pressure differential is formed within the housing 36 causing the receptacle 3 to be instantaneously squeezed or otherwise compacted laterally, thereby driving a continuous flow of the adhesive from the receptacle 3 until the receptacle 3 is emptied.

The hollow spike 37 has an internal through-bore providing an outlet from the housing 36 and a subsequent passage for the adhesive 38 from the receptacle 3 to flow to a valve 39 of an exit block 40 and subsequently through a further valve 41 and into tubing 42. The flow of the adhesive 38 is caused by the increase of pressure upon the receptacle 3 due to the influx of gas from gas the canister 32 into the housing 36. The tubing 42 may be flexible or rigid and Connects at its distal end to a manifold entry valve 43, leading into a manifold 44.

The manifold 44 is generally made from plastic and comprises a longitudinal member with longitudinal channels or grooves. The channels direct the flow of the adhesive 38 entering the manifold 44 through the entry valve 43 along one or more edges of the manifold 44. The manifold 44 is fixedly secured to one of the holding plates 29 such that the longitudinal edge of the manifold 44 abuts out from the longitudinal edge of the holding plate 29 (the abutting edge 45).

When the spoiling system is activated, the adhesive 38 is directed from the receptacle 3 and into and along the channels of the manifold 44 before being dispersed along the abutting edge 45 or edges of the manifold 44 and holding plate 29 to spray onto and across the proximal side 46 of all the banknotes 25 held within the cassette 2.

The manifold 44 is only provided on one holding plate 29 (i.e. it is only located along one side of the cassette lid 28) and hence over one side of the longitudinal axis of the banknotes 25.

As the adhesive 38 is dispersed only along the abutting edge 45 of the manifold 44 and the holding plate 29, the adhesive 38 is directed in a substantially linear, predictable and orderly manner along an area of the banknotes proximal to the abutting edge 45. The edge 45 of the manifold 44 forms a barrier to prevent the adhesive from dispersing further across the width of the banknotes to ensure that the adhesive only extends across a predetermined distance along the width of the banknote block.

Accordingly, when cured, the banknotes 25 are bonded at the proximal side 46 but not at the distal side 47. If a banknote is able to be peeled away at the proximal (bonded) side 46, obvious physical damage will be caused (tearing or surface disfigurement) rendering it unusable to such an extent that it will be rejected by any machine. Additionally, as the distal side 47 of the banknotes 25 are not bonded, it is possible for each individual banknote to be authenticated by separating them at that side.

It will be appreciated that the spoiling agent used in the present invention can vary, for example, it may be an adhesive, dye, an acidic or alkali Corrosive solution or any other such fluid material may be used to cause obvious damage to banknotes at the side proximal to where the spoiling agent has been applied whilst enabling each individual bank note to be authenticated along the distal side.

It will be appreciated that the foregoing is merely descriptive of example embodiments of this invention and that modifications can readily be made to these embodiments without departing from the true scope of the invention as set out in the appended claims.

The invention claimed is:

1. An apparatus for spoiling banknotes arranged in a block formation within a cassette, the apparatus comprising:

the cassette for housing the block of the banknotes;

a main housing in which is located a receptacle containing a spoiling fluid comprising adhesive, the housing having a spray bar or manifold extending along one side; and the receptacle arranged to release the fluid therefrom and into the spray bar or manifold, wherein, in use, the spray bar or manifold extends across a full length of the block of the banknotes within the cassette and the spray bar or manifold directs the spoiling fluid over and along the full length of the block of the banknotes within the cassette, wherein an edge of the spray bar or manifold forms a barrier to prevent the spoiling fluid from dispersing further across a width of the block of the banknotes, the apparatus thereby being configured to adhere only a portion of the width of the block of the banknotes.

2. The apparatus according to claim 1, wherein the spray bar is secured to the main housing or formed integral with the main housing.

3. The apparatus according to claim 1, wherein the cassette comprises a hinged lid and the main housing is secured to an underside of the lid.

4. The apparatus according to claim 1, wherein the receptacle is configured to release the spoiling fluid therefrom in response to a signal indicative of an attempted theft.

5. The apparatus according to claim 1, further comprising a first end housing attached, in use, to an end of the main housing, wherein the first end housing is constructed in first and second parts, the first part being rotatable relative to the second part, and wherein the actuator is located with the first part such that the first part can be rotated relative to the second part to expose the actuator for replacement.

6. The apparatus according to claim 5, wherein the first end housing further includes a piston assembly configured to be activated by the actuator, to drive a piston into the main housing.

7. The apparatus according to claim 6, further comprising a second end housing attached, in use, to an end of the main housing opposite to that receiving the first end housing, the second end housing including a spike extending inwards into the main housing operable to pierce the receptacle on abutment, and thereby release the spoiling fluid.

8. The apparatus according to claim 7, wherein the spike has an internal throughbore to provide an outlet through which the spoiling fluid can flow from the receptacle into an internal channel formed in the second end housing.

9. The apparatus according to claim 8, wherein the second end housing has an exit aperture to allow the spoiling fluid to exit the second end housing into the internal channel.

10. The apparatus according to claim 1, wherein the spray bar is generally L-shaped.

11. A method for spoiling banknotes arranged in a block formation within a cassette, comprising:

releasing spoiling fluid comprising adhesive from a receptacle located within a housing, the housing having a spray bar or manifold extending along one side such that the released spoiling fluid flows from the receptacle into the spray bar or manifold, wherein, in use, the spray bar or manifold extends across a full length of the block of the banknotes within the cassette and the spray bar or manifold directs the spoiling fluid over and along the full length of the block of the banknotes within the cassette; and an edge of the spray bar or manifold forms a barrier to prevent the spoiling fluid from dispersing further across a width of the block of the banknotes, thereby adhering only a portion of the width of the block of the banknotes in use.

12. The method of claim 11, wherein the spoiling fluid flows from the receptacle under pressure of gas released from a gas canister, the method further comprising:

pushing a piston to push the receptacle against the housing and against a spike, the spike piercing the receptacle and releasing the fluid from the receptacle.

13. The method of claim 12, wherein the spike is hollow and has an internal through-bore providing an outlet from the housing and a subsequent passage for the spoiling fluid to flow from the receptacle.

* * * * *